United States Patent [19]

Teufel

[11] 4,014,119

[45] Mar. 29, 1977

[54] VARIABLE FRAME FOR THE RECEPTION OF NATURALLY STIFF DISPLAY ARTICLES

[76] Inventor: Karl Heinz Teufel, Stergweg 4, 79 Ulm, Germany

[22] Filed: Jan. 8, 1976

[21] Appl. No.: 647,304

[30] Foreign Application Priority Data

May 28, 1975 Germany ..... 2523557

[52] U.S. Cl. ..... 40/152; 40/156

[51] Int. Cl.[2] ..... G09F 1/12

[58] Field of Search ..... 40/152, 154, 155, 156, 40/157, 158 R

[56] References Cited

UNITED STATES PATENTS

| | | | |
|---|---|---|---|
| 2,633,653 | 4/1953 | Angus et al. | 40/155 X |
| 2,970,397 | 2/1961 | Roseman | 40/156 |
| 3,132,431 | 5/1964 | Petrie | 40/156 X |
| 3,613,280 | 10/1971 | Tuchinsky et al. | 40/155 |

*Primary Examiner*—Louis G. Mancene
*Assistant Examiner*—John H. Wolff
*Attorney, Agent, or Firm*—Townsend and Townsend

[57] ABSTRACT

A frame for displaying sheets which has a generally U-shaped track for placement over one or more edges of the sheet. The track has a center section and a pair of spaced-apart legs protruding from the center section, the spacing between the legs being greater than the thickness of the sheet so that sheets of varying thicknesses can be received in the track. One of the legs depends at an acute angle from the center section towards the other leg and has itself an L-shaped cross-section so that it ends in a protrusion extending away from a remainder of that leg and the center section. A triangular tightening bar has a pair of perpendicular sides and an angularly inclined side joining the perpendicular sides. The perpendiculr sides engage the sheet and the center portion, respectively. The perpendicular side of the tightening bar engaging the center section is disposed between the sheet and the rib and a T-shaped clamp supported by the L-shaped leg applies a force to the tightening bar via a bolt threaded into the clamp for moving the bar parallel to the center section towards and into engagement with the sheet so that the sheet can be clamped between the bar and the other leg of the track. The clamp further includes an arm for securing the track and the sheet to an upright support wall.

6 Claims, 8 Drawing Figures

VARIABLE FRAME FOR THE RECEPTION OF NATURALLY STIFF DISPLAY ARTICLES

The invention relates to a variable frame for the reception of naturally stiff (or rigid) display articles, consisting of at least one rail which encloses the display article at one edge, has a U-shaped or similar profile, and which possesses a clamping device with which the display article and, where appropriate, its components can be firmly held.

By variable frames is to be understood not only suspendable but also standing frames, thus also picture frames. Both U-shaped profiles and similar, e.g., C-shaped profiles are suitable for the frames.

The term "naturally stiff display articles" is to be understood to include not only naturally stiff carriers of pictures or texts, but also flexible display articles that become stiff when combined with a covering glass and/or a backing, and clamped thereto.

It is an object of the invention to produce a variable frame for display articles which enables a problem free, rapid exchange of the display article, the reception of display articles of widely varying thicknesses and which above all is cheap to produce and readily shipped as a packet.

This object is achieved by the invention in principle through the fact that the spacing between the two free legs of the rail is greater by a multiple of the thickness of the display article to be received, and, further, in that the clamping device disposed between the rear of the display article inserted in the rail and the opposing leg of the U-shaped rail is constructed of a plurality of parts, which are adjustable relative to one another in a direction parallel to the central part of the profile.

Although just a single rail suffices to achieve the object of the invention in the case of a display article naturally stiff in its own right, the disposition of at least two rails on edges of the display article opposite to one another provides additional advantages: The display article does not need to be naturally stiff itself, the two rails can be disposed both on the upper and lower edges and also on the two lateral edges of the display article, since they — together with the display article and its parts — form a naturally stiff frame. Thus a frame in accordance with the invention can consist of only two individual rails.

If — for example for visual reasons — a closed frame is necessary, then in accordance with a further feature of the invention this can be so attained that the frame consists of as many individual rails as the display article has sides, as a rule four rails. The rails correspond in their lengths to the length of the corresponding sides of the display article and the ends of the rails are bevelled.

The clamping means in accordance with the invention secure the individual rails so firmly to the display article or its parts, without their being joined together, that the frame is as naturally stiff as the known frames, the sections of which are, for example, glued together.

The production of the frame of the present invention is considerably simpler, the rails can be slipped — laid upon one another — as a simple and not unwieldy packet, and joined on the spot to form a solid frame on the display article. It is further possible to supply the rails in standard lengths and cut them up on the spot according to the dimensions of the picture on which they are to be used. Glass and backing do not have to be supplied, so that considerable transportation costs are saved.

The frame in accordance with the invention can even be so formed that the free legs of the rails overlap broadly over the display article; but it is also possible to allow these free legs to overlap only by a very small amount, if the impression is desired that the display article is not framed. This is possible since the connection between the rails and display article is effected through clamping means which already produce a firm bond with a quite small overlap.

The clamping means could indeed be fixed to the rails, but it is considerably more advantageous if the clamping means are freely insertable in the rails and and are movable along the rails. They can thus be adapted to any size of the individual display articles and always put at the place where they best produce a connection.

In itself any clamping means could be employed with the rails in accordance with the invention; according to a further feature of the invention it is however more advantageous if the clamping means consist of a strip or strips having a triangular cross section bearing against the back of the display article and a tension block guided on the other limb of the profile. The clamping means then applies an angularly inclined force against the strip and displaces the strip parallel to the center part of the rail against the display article, until the strip firmly engages the article.

This formation of the strips is quite an important feature of the invention, since the triangular section avoids the direct application of a force acting perpendicularly on the cover plate; the shattering of a protective glass is thus prevented.

Preferably the section corresponds to a right-angled triangle, with the clamping means bearing against the hypotenuse of the triangle.

In order to be able to guide the clamping means in the rail, in accordance with a further feature of the invention the rearward free leg of the rail is bent at an acute angle to the central part of the rail towards the display article, and then is again bent outwardly and down; a guiding rib for the clamping means is also provided on the central part of the rail.

The clamping means itself preferably consists of a block and a pressure screw carried on it, which in its turn acts against the pressure strip in the direction of the upper, forward angle of the rail.

A simpler clamping means consists in accordance with another feature of the invention of two clamping wedges displaceable relative to one another parallel to the rail axis, the total height of which alters with the movement. Finally the clamping means can also consist of a screw and nut, when the nut is fixed in location but is disposed rotatable.

These and further features of the invention are apparent from the embodiment examples of the invention shown diagrammatically in the drawings; individually they show:

FIGS. 1 to 6 illustrate various ways in which the rails can be applied to the peripheries of display articles in accordance with the present invention to form intermittent or continuous frames for the articles, FIG. 7 is a section through a length of rail and illustrates the clamping means of the invention in detail, and FIG. 8 is a perspective view of the length of rail and the clamping means shown in FIG. 7.

DESCRIPTION OF THE PREFERRED EMBODIMENTS

Figure 1:
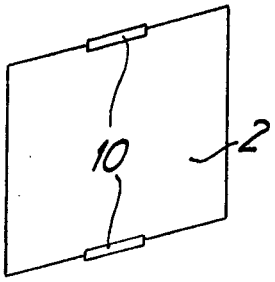

Referring to FIG. 1, a naturally stiff display article can be held by means of a small or a larger section of rail in accordance with the invention. The rail can accent display articles varying very considerably in thickness in this way.

A display article 2 rigid in itself or together with a transparent covering means and/or together with a backing can be held just with two short rails 1C, as indicated in FIG. 1.

Figure 2:
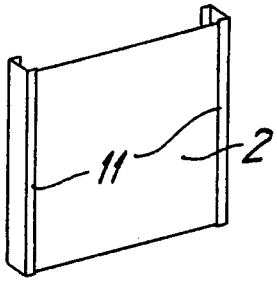
Figure 3:
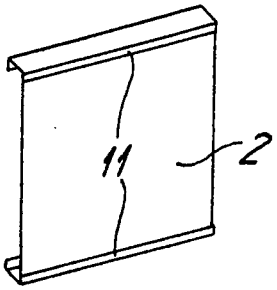

FIG. 2 discloses two through rails 11 that are fixed laterally to the display article. Thus the frame parts in accordance with the invention do not have to be at top and bottom (as in FIG. 3), but can also be disposed laterally. It can be seen from FIG. 2 that this display article with the lateral rails can also be used as a picture stand.

Just these three embodiment examples of the invention show clearly that the display article does not have to be inserted in the frame and fixed in it, but that conversely the frame parts are fixed to the display article or to its parts. The frame is thus constituted by the rails and the display article together.

Figure 4:
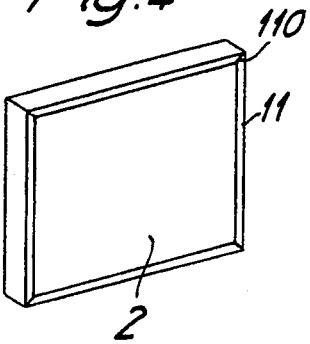
Figure 5:
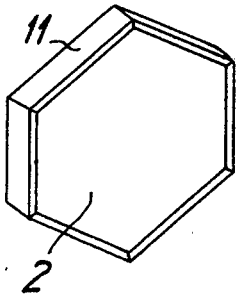
Figure 6:
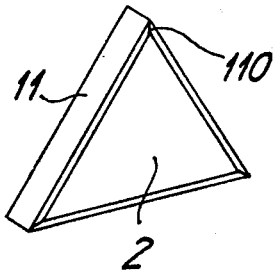

In the FIGS. 4, 5 and, 6 and three forms of embodiment of the invention are illustrated schematically which in each case exhibit a complete frame, even if this is only assembled from individual rails, without the rails being joined to one another. The pieces of rail are just cut to length, provided with an appropriate bevel 110 and pressed together when fixed onto the display article.

It is immediately evident what advantages such a construction method brings with it.

The necessary inventory consists only of individual rails of different lengths, with and without bevels. They are supplied as bundles of rails, the appropriate glass is incorporated at the assembly point, or the user himself cuts the glass.

Figure 7:
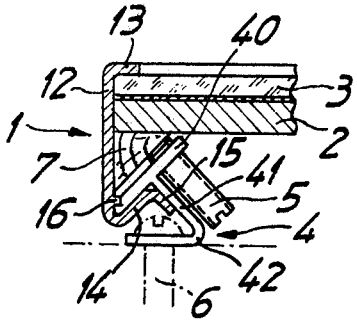
Figure 8:
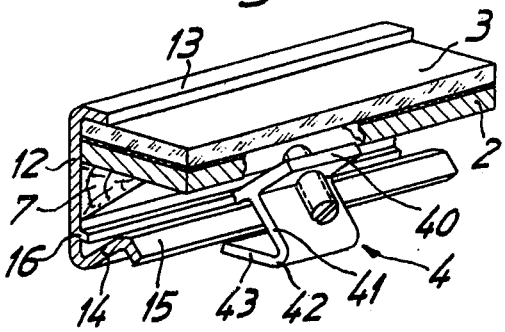

In FIGS. 7 and 8 details of the clamping device in accordance with the invention are now illustrated, in the forms in which they are preferred. In these figures 1 is the U-shaped rail, 12 the central part of the rail, for example resting against a wall, 13 the upper — front — free leg of the rail slightly overlapping the display article; 2 identifies the display article, 3 the transparent covering means and 14 is the lower — rear — second and obliquely upward directed, bent leg of the rail. The upward bent end of this rail leg is identified with 15 and there is a guide rib 16 for the tension block 4. The strip as a part of the clamping means is identified with 7, it can be made of any material, but a relatively soft material is to be preferred, such as wood or similar.

The tensioning device consists first of all of the block 4, which has a cross section; the upper transverse bar is identified with 40 and the foot of the T with 41. The transverse bar carries a threaded bore for the tension screw 5. 42 is a guide rib and 43 is a bent-back lug into which a fixing screw 6 can be inserted, with which the frame can be attached to a wall.

The rails are mounted on the display article in the following manner: display article and covering means — if necessary, a backing also — are laid one upon another; these pieces are then laid upon the inside of the rail 13. The strip 7, which extends over the whole length of the display article or only over a part of it, is pushed in bearing against the back of the display article or of the backing. The screw 5 is screwed in and then the tension block so set in the rail so that the transverse bar of the T comes to lie in the angle between the rail parts 12 and 14 behind the rib 16. In this position the foot 41 of the T is bearing against the bent-back end 15 of the rear 14, the rib 42 of which at the edge of the part 15 of the rail takes on the guidance of the tension block (FIGS. 7, 8).

The screw 5 can now be tightened until the tension block is firmly located. The display article 2 and its parts 3 are now firmly secured to the rail, and together with it or them constitite the frame. The strip 7 and tension block 4 can however be inserted in the rail limb before the display article is laid in position, if the screw 5 has first been loosened.

FIG. 7 makes it evident that the screw 5 bears against the hypotenuse of the triangular strip and does not push against it in the direction of the display article, but in the direction of the corner between center part 12 and leg 13 of the rail so that the strip is wedged between the center section of the rail and the display article 3 supported by rail leg 13. Through this the loading pressure of the display article against the rail leg 13 is less, the covering glass 3 cannot be cracked. This is the case even when the overlapping leg 13 is relatively short. The insertion of a flexible buffer can in particular be avoided if the strip 7 is of a relatively softer material, such as wood.

I claim:

1. Apparatus for framing and displaying one or more sheets comprising in combination: at least one sheet having lateral edges, a generally U-shaped member for placement over at least one of the edges, the member having a center section and a pair of spaced-apart legs protruding from the center section, the spacing between the legs being greater than the thickness of the sheet so that sheets of varying thicknesses can be received in the U-shaped member, one of the legs depending at an acute angle from the center section towards the other one of the legs and having itself an L-shaped cross-section so that said one leg ends in a protrusion extending away from a remainder of said one leg and of the center section, the U-shaped member further including a longitudinally extending rib protruding from the center section, spaced from and extending towards said one leg; a tightening bar having a triangular cross-section and defining a pair of perpendicular sides and an angularly inclined side joining the perpendicular sides, the perpendicular sides engaging the sheet and the center section, respectively, so that the angularly inclined side faces said one leg of the U-shaped member, the perpendicular side engaging the center section being further disposed between the sheet and the rib; and clamping means for applying a force to the tightening bar for moving the bar parallel to the center section towards and into engagement with the sheet so that the sheet is clamped between the bar and said other one leg of the U-shaped member, the clamping means being defined by a clamp having a generally T-shaped cross-section in engagement with said one leg and the rib, a bolt threadably engaging the clamp and positioned to engage the tightening bar so that the bolt can be threaded against the bar for applying said force, the clamp further including an arm extending at an angle from a remainder of a bar and positioned to be generally parallel to the other leg of the U-shaped member, the arm including means for securing the arm and therewith the clamp, the U-shaped member and the sheet to an upright support wall.

2. Apparatus for framing a sheet having a plurality of edges, comprising at least one generally U-shaped track having a pair of spaced apart legs projecting from an intermediate center section for placement of the track over at least one edge of the sheet so that the sheet is proximate one of the legs of the track, the spacing between the legs being greater than the thickness of the sheet, and means for securing the sheet to the track, the securing means including an elongate bar having a triangular cross-section and being disposed between the sheet and the other one of the legs of the tracks, the bar being defined by a pair of substantially perpendicular sides and a third side, one perpendicular side of the bar butting against the sheet and the other perpendicular side butting against the intermediate center section of the track, clamping means for engaging the other one of the legs, the clamping means including means exerting a force against the third side of the elongate bar wedging said bar toward the intermediate center section and said one of the legs.

3. Apparatus according to claim 2 wherein the other one of the legs extends from the intermediate center section at an acute angle, and wherein the clamping means comprises a clamping member having a generally T-shaped cross-section, and wherein the force applying means comprises a bolt threadably engaging a cross-bar of the T-shaped clamping member and adapted to apply said force against the elongated bar.

4. Apparatus according to claim 3 including a protrusion running parallel to the track and depending at an angle from a free-end of said other leg, and wherein the clamping member includes a center web engaging said protrusion.

5. Apparatus according to claim 4 wherein the clamping member includes an arm depending at an acute angle from a free end of the center web and extending towards the center section of the track.

6. Apparatus according to claim 5 including means on the arm for securing the arm and therewith the track and the sheet to an upright support.

* * * * *